United States Patent [19]

Fulier

[11] 4,150,555

[45] Apr. 24, 1979

[54] BLIND RIVETING UNIT

[75] Inventor: Jozef Fulier, Nove Mesto nad Vahom, Czechoslovakia

[73] Assignee: Vyskumny ustav mechanizacie a automatizacie, Nove Mesto nad Vahom, Czechoslovakia

[21] Appl. No.: 852,927

[22] Filed: Nov. 18, 1977

[30] Foreign Application Priority Data

Nov. 18, 1976 [CS] Czechoslovakia ..... 7418.76

[51] Int. Cl.[2] ..... B21J 15/34

[52] U.S. Cl. ..... 72/114; 29/243.54; 29/509

[58] Field of Search ..... 72/391, 114, 75; 29/243.52, 243.53, 243.54, 509

[56] References Cited

U.S. PATENT DOCUMENTS

| | | | |
|---|---|---|---|
| 964,202 | 7/1910 | Bonnesen | 227/81 |
| 3,838,499 | 10/1974 | Fuller | 29/243.52 |
| 3,924,434 | 12/1975 | Fulier | 72/75 |

*Primary Examiner*—C. W. Lanham
*Assistant Examiner*—Gene P. Cosby

[57] ABSTRACT

A pressure riveting unit for blind or one-side riveting provided with a two-arm riveting head, there being a pull stud for hollow rivets on the end of each arm. The head is adapted to be turned through 180°, thereby permitting the simultaneous fixing of one hollow rivet blank on one pull stud and the forming of a rivet head on a rivet blank which has been previously fixed on the other pull stud.

7 Claims, 5 Drawing Figures

Figure 2A:
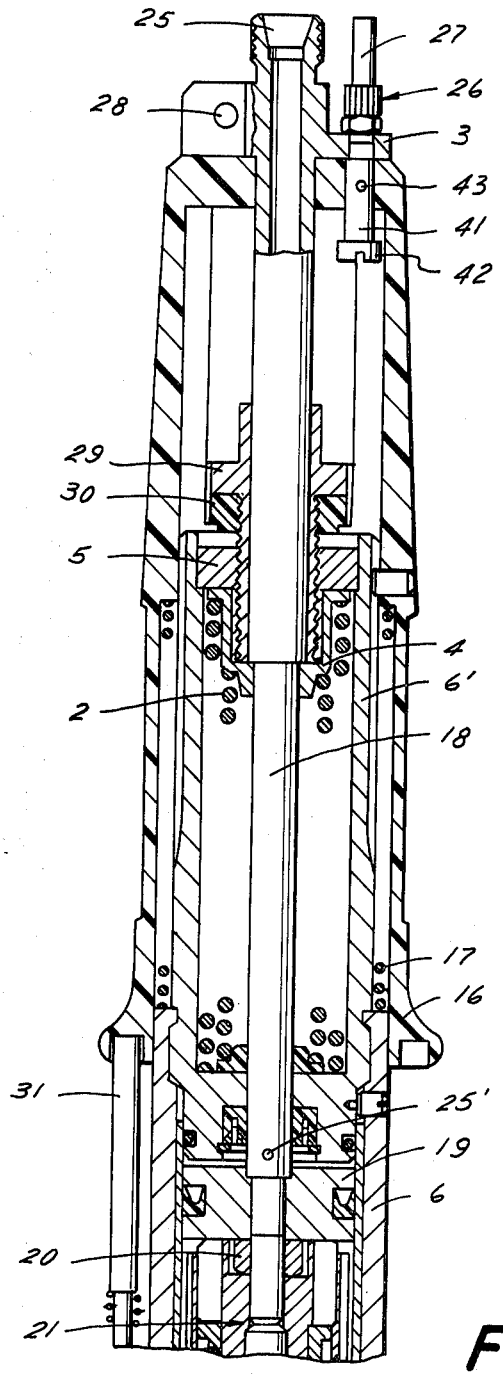

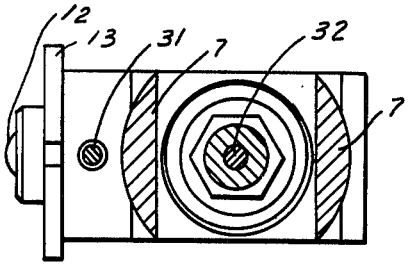
FIG. 3
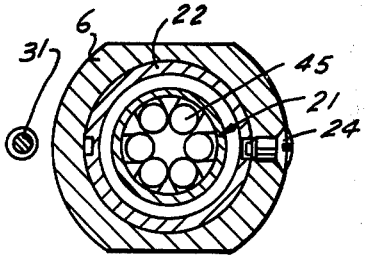
FIG. 4
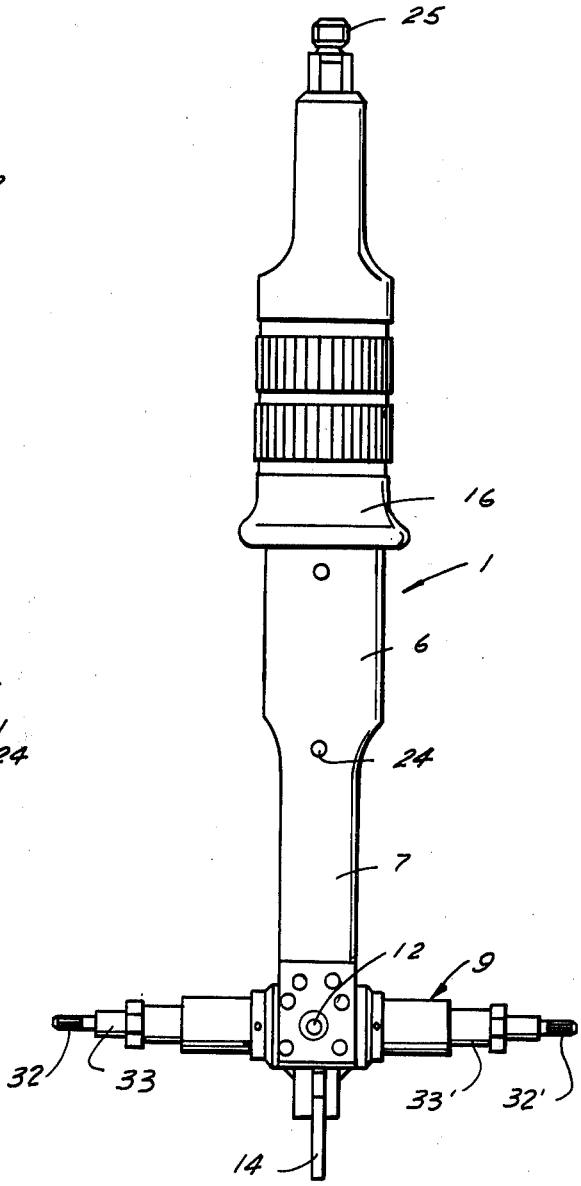

BLIND RIVETING UNIT

BACKGROUND OF THE INVENTION

This invention relates to a pressure riveting unit for blind or one-side riveting using tubular or hollow rivets.

Manual riveting units for one-side riveting are known wherein the anchoring of the rivet blank to a stud of a working tool is performed separately by an anchoring device. Such manual riveting device has the drawback that its productivity is reduced by the separate anchoring of the rivet blank to a stud of the riveting device. Another drawback of the manual device is the large amount of physical effort required of the attendant and thus the danger of his exhaustion with a consequent lessening of the accuracy of the riveted connections.

SUMMARY OF THE INVENTION

It is an object of this invention to mitigate these drawbacks and to provide a riveting unit for one-side riveting which is more easily handled and which can be operated more efficiently.

According to this invention the forming head of the riveting unit is slidably supported in an adjustable cover, which is adjustably disposed in a working cylinder. The upper end of the working cylinder is firmly connected to the main body of the unit. The lower end of the working cylinder extends into a fork, in which the riveting head is supported for rotation around an axis perpendicular to the longitudinal axis of the riveting unit by means of aligned pivot pins. One of the pivot pins is provided with a transverse recess and is encompassed by an index disc firmly connected thereto. The shaping head is connected to a working piston by a piston rod extending in the longitudinal direction and provided with a channel terminating between the lower face of the main body and the working piston.

The upper end of the piston rod extends beyond the handle, which is slidably and resiliently supported on the working cylinder. The lower face of the handle is supported by a spring loaded control rod engaging by way of an index disc into a transverse recess in one of the pivot pins. The piston rod is cushioned from the main body by an elastic element. The upper face of the main body is closed by a closing screw. An adjustable stop, slidable with respect to the piston rod, is adjustably supported by the closing screw. The piston rod terminates above the upper face of the handle in a flange, which is provided with a position indicator consisting of a shaft terminating in a head. The shaft is slidable in the face wall of the handle and is provided with a channel for the control medium, connected by a tube with means for controlling the pressure source.

The pressure riveting unit for one-side riveting according to this invention achieves a higher productivity of high quality rivet joints and the elimination of troublesome manual work. Another advantage of this arrangement is the possibility of its application on assembly lines.

The attached drawings show an exemplary embodiment of a pressure riveting unit for one-side riveting according to this invention.

Figure 2B:
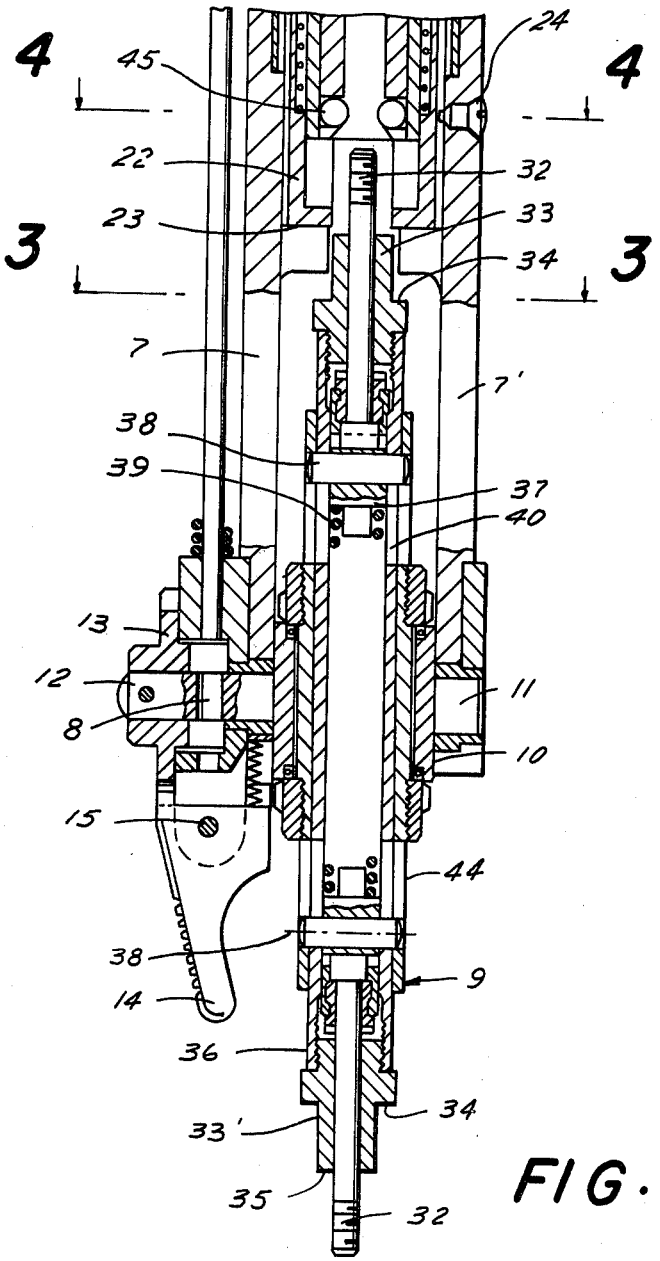

In the drawings:

FIG. 1 is a view in side elevation of a device in accordance with the invention;

FIG. 2*a* is a view in axial cross section on an enlarged scale through the upper end portion of the device shown in FIG. 1;

FIG. 2*b* is a view in axial cross section on an enlarged scale through the lower end portion of the device shown in FIG. 1, FIGS. 2*a* and 2*b* taken together constituting a complete view in cross section of the device;

FIG. 3 is a view in transverse section through the device, the section being taken along the line 3—3 in FIG. 2*b*, and FIG. 4 is a view in transverse section through the device, the section being taken along the line 4—4 in FIG. 2*b*.

Turning now to FIG. 1, the riveting unit shown has a main body 1 having an upper portion 6 and a lower portion having opposed parallel legs 7, 7', there being a handle portion 16 mounted on the upper end of the unit. A riveting head 9 is mounted between legs 7, 7' for pivoting about aligned pivot pins 11 and 12 (FIG. 2*b*). The riveting head 9 carries oppositely extending abutment elements 33, 33', which in turn serve as guides for identical pull studs 32, 32', respectively, which are reciprocable with respect thereto. The riveting head 9 is pivoted as indicated in FIG. 1 between two vertical positions thereof, in one position the abutment element 33' and pull stud 32' lying in a lower vertical position, as shown in FIG. 2*b*, and in the other position the abutment element 33 and the pull stud 32 lying in a lower vertical position. When a pull stud having a rivet affixed thereto is disposed in its lower vertical position, it is applied to holes in work pieces to effect a riveted joint therebetween by pulling the pull stud upwardly relative to its respective abutment element. At the same time, and by the same operation of the parts of the device, a fresh rivet blank which has previously been applied to the pull stud which now lies uppermost, is crimped or otherwise preliminarily deformed to affix it to such pull stud, thereby to be immediately in readiness to be used in forming a riveted joint when the head 9 has been turned to present the pull stud carrying the preliminarily deformed rivet in the lower vertical position of such stud and rivet.

It will be evident that the device of the invention eliminates the necessity of separately crimping or otherwise affixing rivet blanks to pull studs, a procedure which is necessary in accordance with applicant's U.S. Pat. No. 3,924,434.

Turning now to FIGS. 2 to 4 inclusive of the drawings, which show the internal structure of the illustrative riveting unit of the invention, a main body 6' of the unit houses an elastic element 2, in this case such elastic element being a twin pressure spring. The elastic element terminates in a cup 4 which abuts a nut 5 screwed on the upper end of the main body 6'. A working cylinder 6 is fixed to the lower end of the main body 6'. The lower end of the working cylinder 6 extends into the fork 7, 7', on which by means of aligned pivot pins 11, 12 a central suspension body 10 of the two-arm riveting head 9 is rotatably supported. The two-arm riveting head 9 comprises two coaxially disposed and oppositely extending pull studs 32, 32', the internal ends of which are provided with supports 37, a spring 39 being located between the two supports 37. The supports 37 are provided with carriers 38 engaging into slots 40 in the mantle of an inner sleeve 36 and in an outer supporting sleeve 44 affixed to pivot pins 11, 12. Sleeve 36, which is slidable longitudinally within sleeve 44, has its opposite ends affixed to abutments 33, 33' axially inwardly of shoulders 34 on the abutments.

Thus the sleeve 36 and the abutments 33, 33' reciprocate as a unit relative to sleeve 34. Each of the abutments 33, 33' has a rivet supporting surface 35 at its axially outer end. Opposite to the one of the pull studs 32, 32' which is in the upper position, a forming head 21 with a ball press 45 is slidably supported in the working cylinder 6 by means of an adjustable cover 22 having an inwardly flanged lower end surface 23. The ball press 45 is similar to that disclosed in FULIER U.S. Pat. No. 3,924,434. The adjustable cover 22 is adjustably supported in the forming head and is secured in the working cylinder 6 against turning by a set screw 24. The forming head 21 is fixed to piston rod 18 and is secured by a nut 20. A working piston 19 fixed to the piston rod 18 is disposed above the upper face of the forming head 21.

The piston rod 18 extends at its upper end beyond the handle 16 and is provided on one side with a suspension eyelet 28, and on the other side with a flange 3. A position indicator 26 is provided on the flange 3, such indicator consisting of a shaft 41 terminating in a head 42. The shaft 41 is slidably arranged in the face wall of the handle 16, is provided with a channel 43 for passage of the fluid pressure control medium, and is connected by a tubing 27 with a device (not shown) for controlling the pressure source. A longitudinal feeding channel 25 is provided in the piston rod 18, such channel terminating in a radial passage 25' between the lower faces of the main body 6' and the working piston 19. An adjustable stop 29 with a safety nut 30 is arranged in the closing screw 5 of the main body 6'. The handle 16 is arranged resiliently and slidably by means of a pressure spring 17 on the working cylinder 6. The lower face of the handle 16 is supported by a spring loaded control rod 31, the lower end of which engages by means of an index disc 13 into a transverse recess 8 of the left pivot pin 12. The index disc 13 is fixed on the pin 12, with a control lever 14 engaging with the index disc 13 supported on pivot pin 15 below the pin 12.

The rod 31 checks or monitors the correct position of head 9. By displacing the handle 16 downwards the rod 31 is also displaced in the indexing disc 13 until it enters the transverse recess 8 in the lefthand pivot pin 12. In case the riveting head 9 is not aligned with one of the pull studs 32 facing the forming head, the recess 8 does not confront the rod 31 so that the lower end of the latter abuts the lefthand pivot pin 12. Thereby the piston of the cylinder 6 constituting the driving means for the riveting unit is blocked against downward movement and any further operation of the riveting unit is blocked. The restoration of the operation of the unit is not possible unless the riveting head 9 is correctly positioned. It is to be understood that by pushing down the control lever 14, the index disc 13 is released whereby the head 9 is allowed to turn 180° about the pivot pins 11 and 12, so that the rivet mounted upon the upper pull stud 32 is aligned with the forming head 21.

The Manner of Operation of the Device

After connecting the pressure riveting unit by way of the feeding channel 25 to a source of a fluid pressure medium, for example oil, and connecting the position indicator 26 by the tubing 27 to a control device (not shown) for the fluid pressure source, a tubular or hollow rivet blank is put on the one of the pull studs 32, 32' which is then in the lower position. The index disc 13 is released by turning the control lever 14, permitting a turning of the two-arm riveting head through an angle of 180° and thus positioning the rivet blank which has just been placed on the lower pull stud in its upper position opposite the rivet forming head 21 within the working cylinder 6. After the now lower pull stud has been placed against a fixed supporting surface and the handle 16 has been shifted downwardly, the piston indicator 26 emits a signal to the control device for the pressure source, so that the pressure medium starts to act on the upper face of the working piston 19 via the feeding channel 25. The pressure medium shifts the working piston 19 together with the forming head 21 downwards towards the upper one of the pull studs 32, 32'.

The forming head first anchors the rivet blank on the upper pull stud by deformation of the end of the rivet by the ball press 45. In the course of its continuing downward advance, the adjustable cover 22 strikes with its flanged lower face 23 the shoulder 34 of the upper abutment 33, causing a downward shifting of the upper abutment 33 together with the sleeve 36 and the lower abutment 33'. The lower one of the pull studs 32, 32' remains suspended by means of its carrier 38 in the supporting sleeve 44. The thrusting downwardly of the lower abutment 33 relative to the lower one of the pull studs 32, 32' causes the rivet on such lower pull stud to be headed. When the handle 16 reaches the adjustable stop 29 it ceases to move downwards and the position indicator 26 emits a signal that the working stroke of the piston 19 is finished, thus stopping the supply of the pressure medium via the feeding channel 25. The discharge of the pressure medium from the riveting unit causes the shifting of the working piston 19 into its upper, starting position by the elastic element 2 by way of the piston rod 18. Thus the forming head 21 is pulled off the anchored rivet on the upper one of the pull studs 32, 32'.

After another rivet blank has been put on the lower one of the pull studs 32, 32', the whole cycle is repeated with the difference, however, that the rivet previously anchored on the upper one of the pull studs is, after turning the riveting head 9 through 180° now lies in the lower position. The thus anchored rivet blank is, however, not now supported on a stable of fixed supporting surface, as when starting the riveting operation as above described, but is introduced into aligned openings in two or more work pieces for forming the rivet joint. It will be seen that in the course of the described cycle, simultaneously with the anchoring of the rivet on the upper one of the pull studs 32, 32', a closed rivet head is formed by the lower pull stud, thus finishing the rivet joint.

Although the invention is illustrated and described with reference to one preferred embodiment thereof, it is to be expressly understood that it is in no way limited to the disclosure of such a preferred embodiment, but is capable of numerous modifications within the scope of the appended claims.

What is claimed is:

1. In a blind riveting unit which in one operation anchors a hollow blind rivet blank to one pull stud and heads another rivet blank which has been previously anchored to another pull stud, said unit having a body, a member having aligned oppositely extending first and second arms, the first arm bearing a first pull stud and a first abutment cooperating therewith, the second arm bearing a second pull stud and a second abutment cooperating therewith, the studs being reciprocable relative to the respective abutments, means pivotally mounting the member on the body for rotation between first and second positions which are displaced from each other by an angle of 180°, means including a rivet deforming head mounted on the body to deform and anchor a hollow rivet blank to a pull stud, driving means to move the rivet blank deforming means axially toward a first stud aligned with the head to anchor the rivet blank thereon, and means driven by said driving means in the same direction axially of the arms as the rivet blank deforming head to cause the other pull stud and its abutment to approach each other thereby to head another rivet blank anchored on the second pull stud, the rivet blank deforming head being disposed at the first angular position, and the heading of the anchored rivet blank on the second stud taking place at the second angular position, the improvement which comprises means for controlling said driving means, and means responsive to the turning of the member with respect to the body for preventing movement of the driving means unless the member is turned with respect to the body so that one of the studs is aligned with the rivet deforming head.

2. The apparatus according to claim 1, wherein the studs are affixed to the respective arms, and the abutments reciprocate longitudinally of the respective arms and studs.

3. The apparatus according to claim 2, wherein the abutments are rigidly connected for joint reciprocation.

4. The apparatus according to claim 1, wherein the driving means is a hydraulic motor having a cylinder and a piston reciprocable therein, the piston driving the rivet blank deforming means coacting with the first stud and the means to head a rivet on the second stud, and the means to prevent movement of the driving means comprises a rod selectively effectively to be interposed and placed in compression between the piston and the body of the unit.

5. The apparatus according to claim 4, wherein the member is pivotally mounted on the body by at least one pivot pin, the pivot pin having a hole therethrough disposed normal to the axis of the pin, the hole in the pin being disposed parallel with the first and second arms, means guiding an end of the rod to confront the pivot pin at right angles to the axis of the pin in the plane of the hole therethrough, said end of the rod passing through the hole in the pin when one of the arms is aligned with the rivet deforming head, the pin blocking the said end of the rod end preventing driving movement of the piston when one of said arms is not aligned with said head.

6. The apparatus according to claim 5, wherein the pivot pin is secured to and turns with the member, and index disc bearing two recesses spaced 180° apart secured to the pivot pin, and a control lever having a detent selectively engageable with one of said recesses, the recesses in the index disc lying in a line parallel to the arms of the member.

7. The apparatus according to claim 6, wherein the lever has a depending arm disposed adjacent the lower arm of the member when said arms are disposed vertically with the upper arm confronting and in alignment with the head, and resilient means constantly urging the lever to cause the detent thereon to engage the index disc.

* * * * *